US006499239B1

(12) United States Patent
Van Berk et al.

(10) Patent No.: US 6,499,239 B1
(45) Date of Patent: Dec. 31, 2002

(54) METHOD FOR EXTRACTING AND GRADING SAND

(75) Inventors: Hendrikus Van Berk, Bunnik (NL); Sjerp Zeldenrust, Winsum (NL)

(73) Assignee: De Groot Nijkerk Machinefabriek BV, Nijkerk (NL)

( * ) Notice: Subject to any disclaimer, the term of this patent is extended or adjusted under 35 U.S.C. 154(b) by 0 days.

(21) Appl. No.: 09/554,551

(22) PCT Filed: Nov. 17, 1998

(86) PCT No.: PCT/NL98/00661

§ 371 (c)(1),
(2), (4) Date: Jan. 26, 2001

(87) PCT Pub. No.: WO99/25932

PCT Pub. Date: May 27, 1999

(30) Foreign Application Priority Data

Nov. 17, 1997 (NL) ..... 1007551

(51) Int. Cl.[7] ..... E02F 1/00
(52) U.S. Cl. ..... 37/314; 37/195
(58) Field of Search ..... 404/81, 75; 37/317, 37/323, 321, 314, 905, 195; 175/67, 212, 213, 424; 16/222; 299/17

(56) References Cited

U.S. PATENT DOCUMENTS

| | | | | | |
|---|---|---|---|---|---|
| 2,518,591 | A | * | 8/1950 | Aston et al. | 299/17 |
| 3,807,514 | A | * | 4/1974 | Murrell | 175/195 |
| 3,916,634 | A | * | 11/1975 | Woodruff | 61/53.74 |
| 4,020,573 | A | * | 5/1977 | Wegewijs et al. | 37/63 |
| 4,140,346 | A | * | 2/1979 | Barthel | 299/17 |
| 4,319,784 | A | * | 3/1982 | Claringbull | 399/64 |
| 4,366,988 | A | * | 1/1983 | Bodine | 299/14 |
| 4,497,519 | A | | 2/1985 | Grable | |
| 4,527,836 | A | * | 7/1985 | Uhri | 299/17 |
| 4,842,336 | A | | 6/1989 | Erämetsä et al. | |
| 4,915,452 | A | * | 4/1990 | Dibble | 299/17 |
| 4,919,204 | A | * | 4/1990 | Baker et al. | 166/223 |
| 4,930,586 | A | * | 6/1990 | Turin et al. | 175/25 |
| 5,125,464 | A | * | 6/1992 | Sabatier | 175/135 |
| 5,127,710 | A | * | 7/1992 | Babichev et al. | 299/17 |
| 5,253,718 | A | * | 10/1993 | Lawler | 175/20 |
| 5,285,587 | A | | 2/1994 | Krenzler | |
| 5,428,908 | A | | 7/1995 | Kerfoot | |

FOREIGN PATENT DOCUMENTS

| | | |
|---|---|---|
| DE | 4416591 C1 | 6/1995 |
| EP | 0279735 A1 | 8/1988 |
| EP | 0737783 A2 | 10/1996 |
| FR | 2262159 | 9/1975 |
| JP | 2248535 | 10/1990 |
| WO | WO 9820208 | 5/1998 |

* cited by examiner

*Primary Examiner*—Robert E. Pezzuto
*Assistant Examiner*—Kristine Markovich
(74) *Attorney, Agent, or Firm*—Young & Thompson

(57) ABSTRACT

A method for extracting and grading or sizing sand, gravel or a mixture thereof, from a pit formed in untouched ground. Liquid is sprayed into the ground, resulting in a fluidized state in the ground, in which state sand or gravel with a relatively high relative density and/or relatively large dimensions moves downwards, and sand or gravel material with a relatively low relative density and/or relatively small dimensions moves upwards. Thus a pit is formed in the ground which contains fluidized sand or gravel, in such a manner that a layered state is obtained. The layer of sand or gravel with a specific relative density and/or size is sucked out, while the remaining fluidized material remains behind in order to stabilize the wall of the pit. The material which has been sucked out is fed to a grading device or sizing device.

3 Claims, 4 Drawing Sheets

METHOD FOR EXTRACTING AND GRADING SAND

The invention relates to extracting sand from an area of ground which is under water. In this process, a volume of water is injected so as to form a sand/water mixture which can than be conveyed via a conveyor line. The sand/water mixture is then fed to a grading device in which sand with the desired grain size is sorted out. In this way, a pool of water with a relatively great depth is formed. However, this depth may not be too great, since the slopes must not exceed a defined maximum gradient percentage. This is because excessive slope gradients are unstable and may cause the banks to collapse.

The surplus sand can be returned to the extraction location. In the long term, a layer of returned sand is formed at the extraction location and may completely cover the ground again. A consequence of such conditions is that layers of sand of the desired composition which lie at greater depths cannot be extracted.

A further problem which emerges in the extraction of sand relates to the grading device or sizing device for collecting sand with the desired grain dimensions. Such devices are highly sensitive to fluctuations in the flow rate and the composition of the mixture supplied.

These fluctuations exhibit considerable peaks and troughs. However, even briefly feeding an excessive volume of mixture leads to the action of the grading device being disrupted. For this reason, a grading device of this nature is operated at a relatively low capacity, well beneath its maximum capacity, so that even considerable peaks in the volume of mixture cannot cause blockages.

Therefore, the object of the invention is to provide a method in which these problems do not occur, or occur to a lesser extent. This is achieved by means of a method for extracting and grading or sizing granular material, such as sand, gravel or a mixture thereof, from a volume of ground, comprising spraying a liquid into the ground, resulting in a fluidized state in the said ground, in which state granular material with a relatively high relative density and/or relatively large dimensions moves downwards, and granular material with a relatively low relative density and/or relatively small dimensions moves upwards, in such a manner that a layered state is obtained, sucking our the layer of material with a specific relative density and/or size, and feeding this material which has been sucked out to a grading device or sizing device.

Since, in the method according to the invention, the ground is locally fluidized and only a certain proportion of desired grain size of the fluidized ground material is sucked out, a fluidized liquid mixture with a relatively high relative density remains behind. A mixture of this nature has a stabilizing effect on the wails of the fluidized pit, with the result that there is no risk of the slope adjoining the pit collapsing.

It is also advantageous that the grading device or sizing device is fed with a more uniform flow rate and a material of more uniform composition, without there being excessive variations in the volume of mixture. A consequence of this is that the said device is less likely to become blocked and can be operated at a higher permissible capacity without the risk of blockage becoming excessively high.

Another beneficial effect is that any unusable fraction which is present can be comminuted during the grading operation and remains behind at the extraction location. This beneficial effect leads to the commercially extractable fraction per unit area of a concession increasing.

The method according to the invention is also suitable for extracting sand fractions which are situated beneath covering layers which are of no commercial interest.

Reference is made to the method which is known from NL-A-7402559 for washing sand, with silt constituents being removed. According to this known method, sand material is separated from silt in a fluidized pit. This method does not disclose how to carry out grading work in the sand material itself or how to feed the extracted material to a grading device or a sizing device so as to obtain an increase in capacity.

The invention will now be explained with reference to an exemplary embodiment which is illustrated in the figures, in which.

Figure 1:
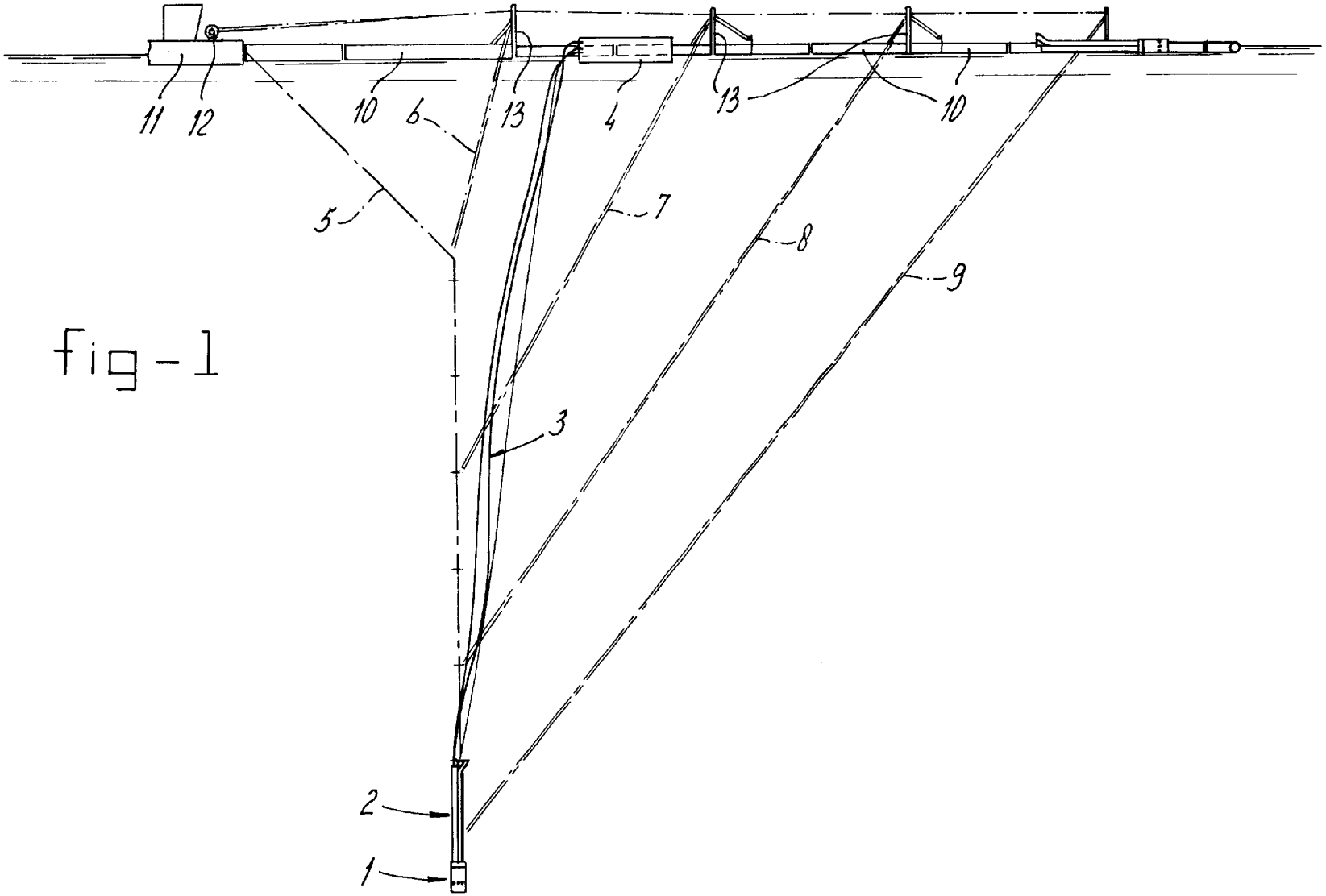
FIG. 1 shows a view of a device for carrying out the method according to the invention.
Figure 2:
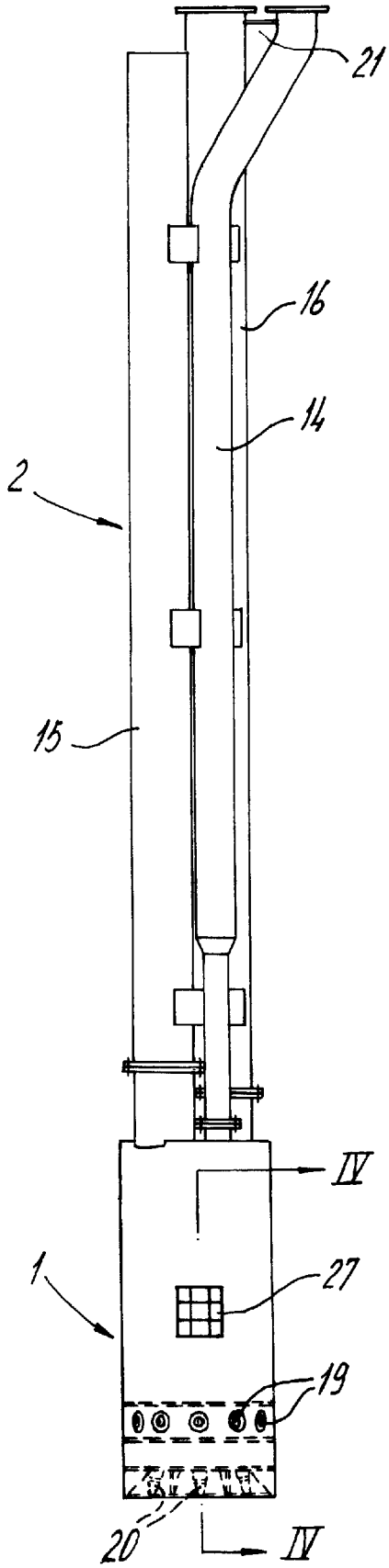
FIG. 2 shows the suction head of this device, with connecting lines.

The device illustrated in FIG. 1 for carrying out the method according to the invention comprises a grading suction head, which is denoted overall by 1 and is connected to jet water pumps (not shown) by means of a number of lines 2 which are to be described in more detail.

The grading suction bead 1 is suspended by means of traction cables 5–9, from a number of further pontoons 10 which are coupled together and are connected to We control vessel 11. This control vessel 11 comprises a number of winches 12, to which the cables 5–9 in question are guided via spacers 13.

The lines 2 which are connected to the grading head 1 comprise a feed line 14 for pressurized water, a feed line 15 for conveying water, as well as a discharge line 16 for the mixture which has been sucked up.

The pressure line 14 is connected to two chambers 17, 18 provided with high-pressure spray nozzles 19, 20. These spray nozzles are operated so as to cause the grading suction head to sink into an area of ground.

Via the feed line 15, incoming or fluidization water, which is denoted by arrow 22, is fed to the underwater bed 23. This creates a mixture 24 which can be sucked up via the open underside 25 of the grading suction head 1. With the aid of conveying water which is supplied via feed line 21 and is denoted by arrow 26, the mixture is guided upwards via the discharge line 16.

Via a hole 27 in the housing of the grading suction head, the incoming or fluidization water 22 is guided outwards.

Figure 3:
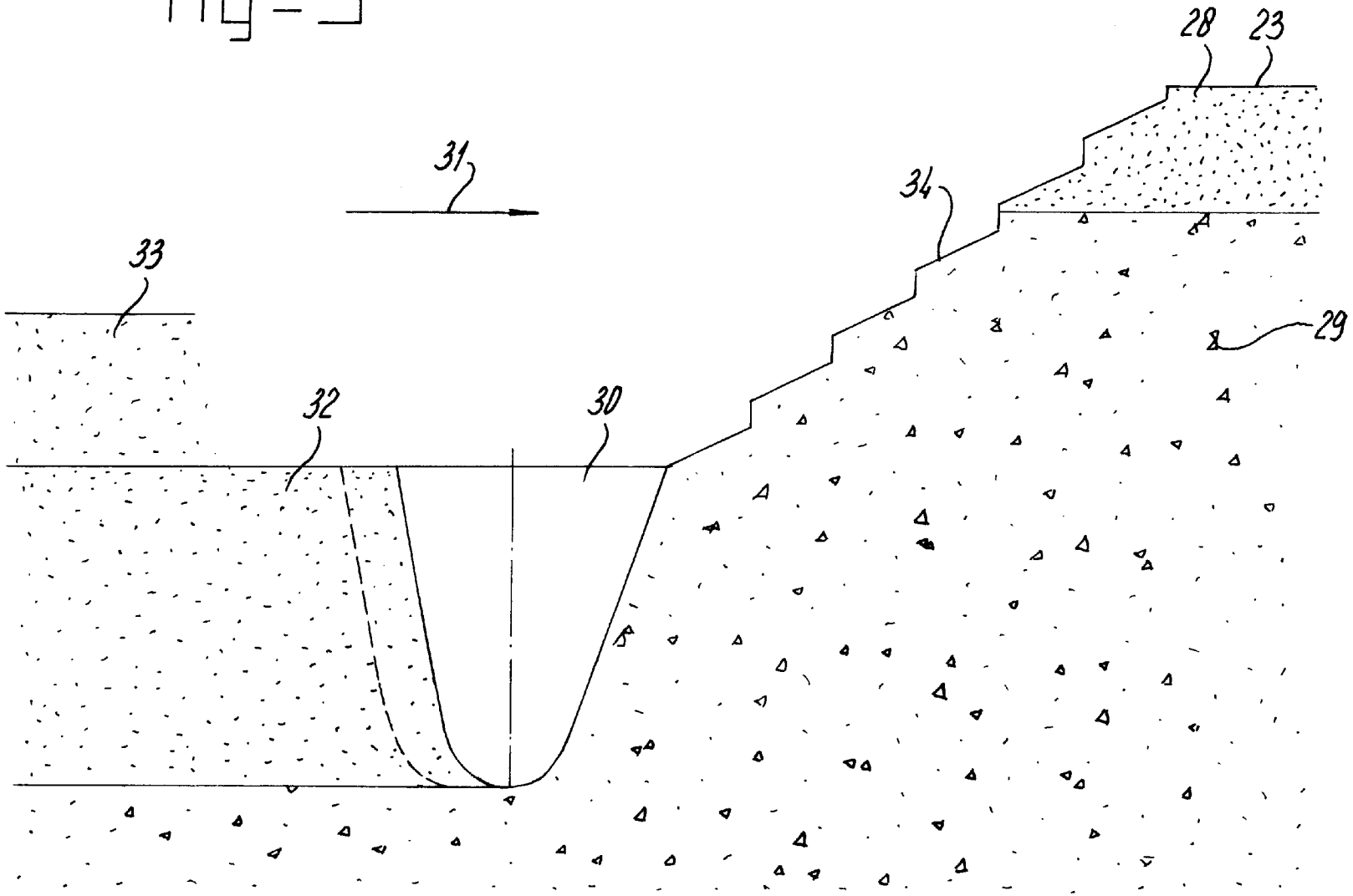
FIG. 3 shows a cross section through an area of ground which is being treated with the device according to the invention.
Figure 4:
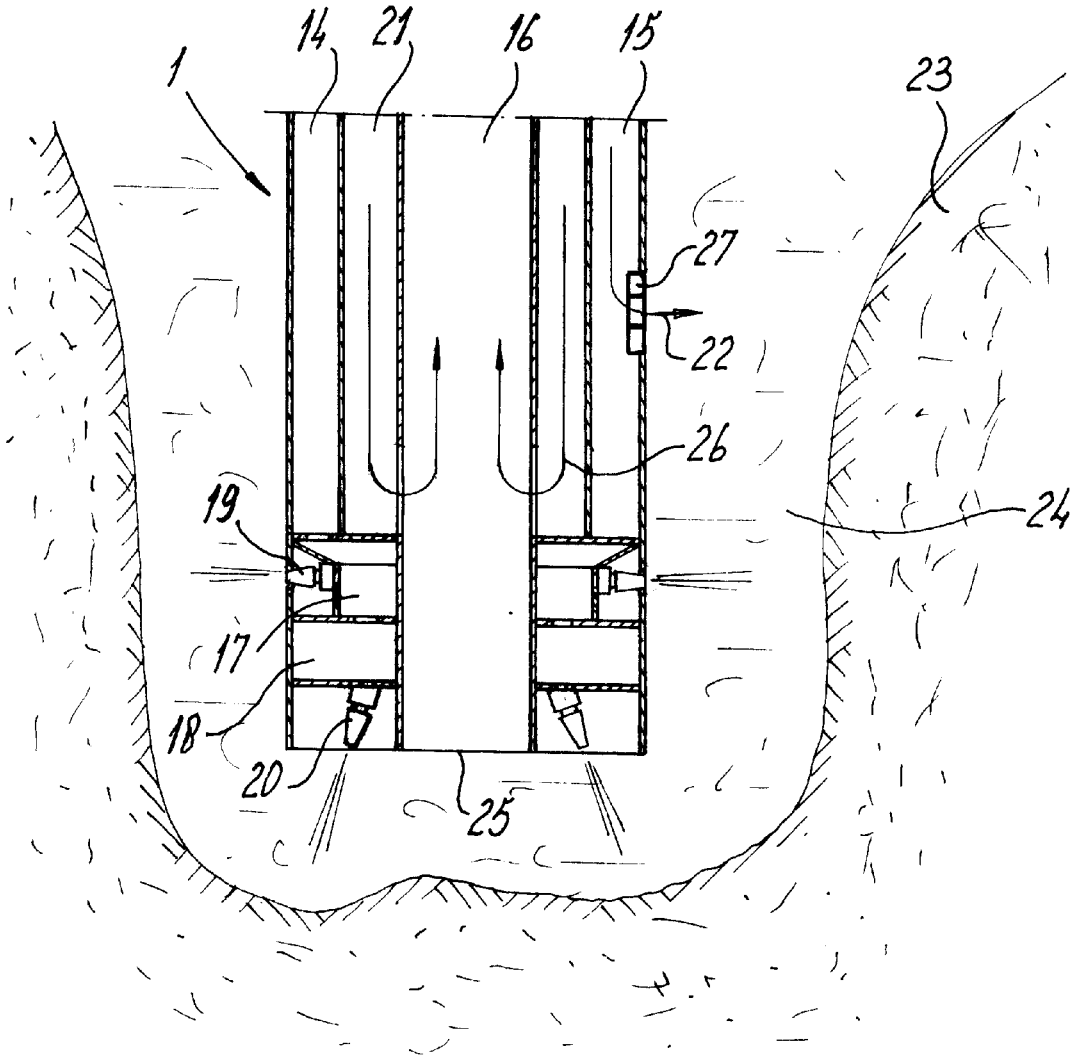
FIG. 4 shows a cross section IV—IV from FIG. 2.

The view in accordance with FIG. 3 shows how the method according to the invention can be carried out using the device described above. For the sake of clarity, the device itself is not shown in this figure.

An underwater bed 23 is composed of a layer of sand 28 which may, for example, be old rinsed sand such as that which remains following a preceding extraction step. Beneath this layer of fine rinsed sand, here is the layer of sand which is to be extracted for example coarse sand D50 with a grain dimension of larger than 300 $\mu$m. The device according to the invention creates a volume of fluidized mixture 30 in which the grading suction head 1 is active in that it supplies fluidization water and removes the mixture of a desired density. The density of the mixture which is sucked out is linked to the volume of conveying water which is supplied via feed line 21 of the grading suction head 1.

The arrow 31 indicates the direction of movement of the device for carrying out the method according to the invention. A layer of settled sand 32 with a grain size which was not of interest for the extraction work and, for example, is less than 300 $\mu$m has accumulated on the rear side, as seen in the direction of movement, of the grading head. On top of this layer 32 there may be a new layer of rinsed sand 33 which emanates from a grading device which is situated on land and has sorted out the sand which is pot desired.

As will be clear from this figure, the coarse sand 29 can be extracted without the underwater bed becoming excessively deep. This is because the underwater bed is supplemented by the abovementioned settled sand 32 and the rinsed sand 33. Also, the fluidized mixture 30, which may, for example, have, a density of 1.75, ensures that the slope 34 of the sand 29 which is yet to be extracted is stabilized, so that the banks are prevented from collapsing.

What is claimed is:

1. A method for extracting and grading or sizing sand, gravel or a mixture thereof, from a pit formed in untouched ground, comprising spraying a liquid into the ground, resulting in a fluidized state in the said ground, in which state sand or gravel with a relatively high relative density and/or relatively large dimensions moves downwards, and sand or gravel material with a relatively low relative density and/or relatively small dimensions moves upwards, in which a pit is formed in the ground which contains fluidized sand or gravel, in such a manner that a layered state is obtained, sucking out the layer of sand or gravel with a specific relative density and/or size, while the remaining fluidized material remains behind in order to stabilize the wall of the pit, and feeding the material which has been sucked out to a grading device or sizing device.

2. A method as claimed in claim 1, performed under water from a vessel that moves in a direction over a body of water.

3. A method as claimed in claim 2, and returning material rejected by said grading device or sizing device to the bottom of said body of water rearwardly of said direction.

* * * * *